United States Patent [19]

Burton

[11] Patent Number: 4,665,998

[45] Date of Patent: May 19, 1987

[54] MECHANICAL WELL JAR

[75] Inventor: Clifton A. Burton, Houston, Tex.

[73] Assignee: Eastman Whipstock, Inc., Houston, Tex.

[21] Appl. No.: 696,997

[22] Filed: Jan. 31, 1985

[51] Int. Cl.[4] ..... E21B 31/07

[52] U.S. Cl. ..... 175/299; 175/304; 175/306; 166/178

[58] Field of Search ..... 166/178; 175/299, 300, 175/302, 304, 306

[56] References Cited

U.S. PATENT DOCUMENTS

| | | | |
|---|---|---|---|
| 3,200,895 | 8/1965 | Womack | 175/306 |
| 3,431,990 | 3/1969 | Webb | 175/306 |
| 4,394,883 | 7/1983 | Briscoe | 175/304 |
| 4,408,670 | 10/1983 | Schoeffler | 175/306 |

*Primary Examiner*—James A. Leppink
*Assistant Examiner*—William P. Neuder
*Attorney, Agent, or Firm*—Vaden, Eickenroht, Thompson & Boulware

[57] ABSTRACT

A mechanical well jar is disclosed having inner and outer tubular members movable longitudinally relative to each other a limited distance for connecting in a pipe string. Annular shoulders on the members engage to limit the relative longitudinal movement of the members. A plurality of laterally spaced, arcuate cam plates are attached to the inner surface of the outer member. Each plate has a laterally extending U-shaped notch opening into the space between the plates and formed with curved outwardly flaring sidewalls. Rollers are mounted on the outer surface of the inner member to extend into the spaces between the cam plates for movement into the U-shaped notches to hold the members from longitudinal movement relative to each other. Resilient means urge the members to rotate in the direction to move the rollers into the notches and allow the rollers to move out of the notches when a longitudinal force is imposed on the jar through the string sufficient for the flared sidewalls of the notches to provide a lateral component of force on the rollers sufficient to overcome the force of the resilient means and move the rollers out of the notches. This allows the tubular members to move longitudinally relative to each other until the annular shoulders stop such movement and transfer the energy stored in the drill pipe to the other member and to the stuck pipe or fish below the jar.

2 Claims, 6 Drawing Figures

FIG.1
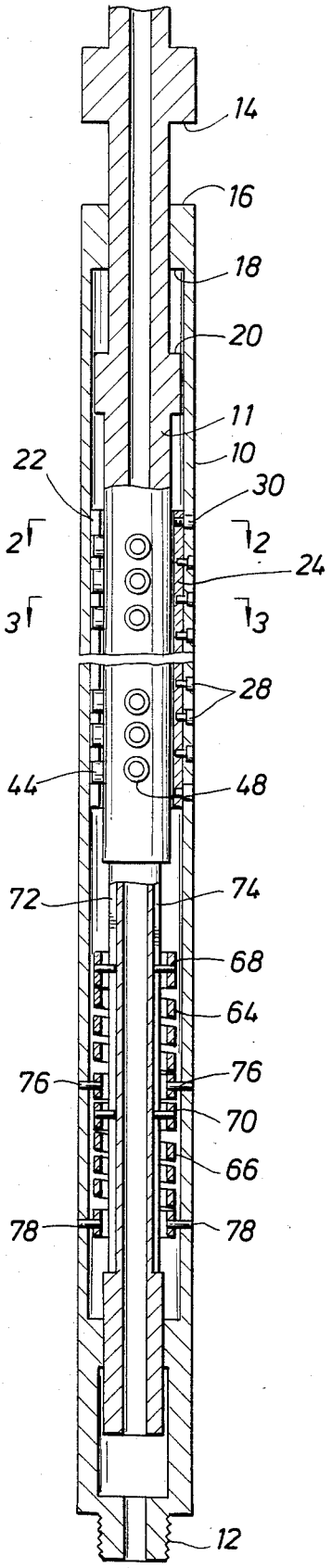
FIG. 2
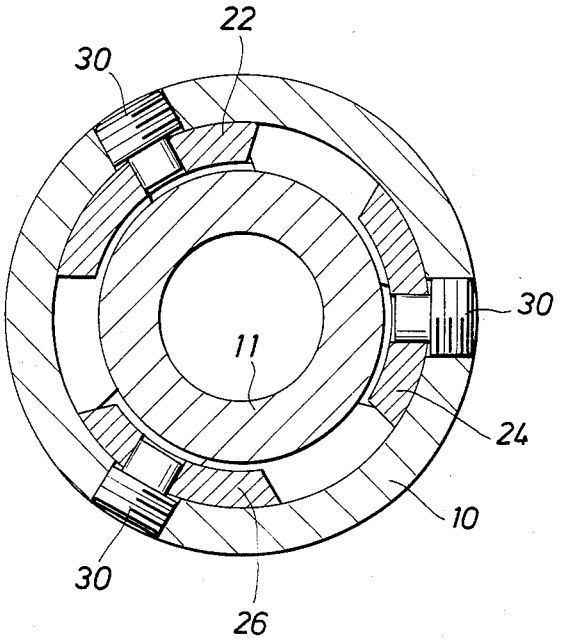
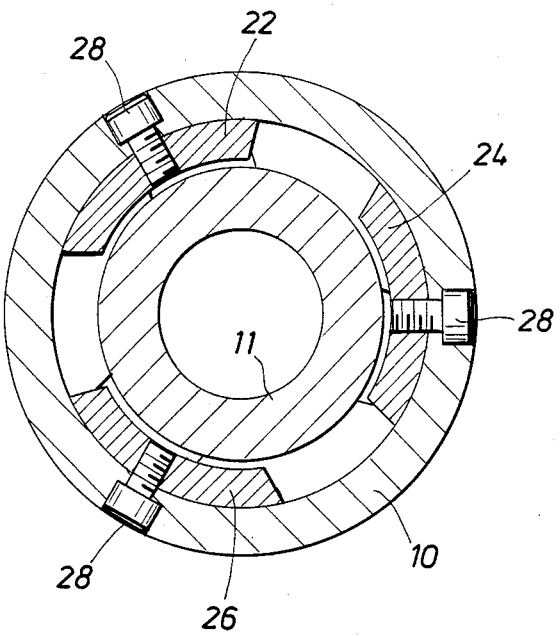
FIG. 3

FIG. 4
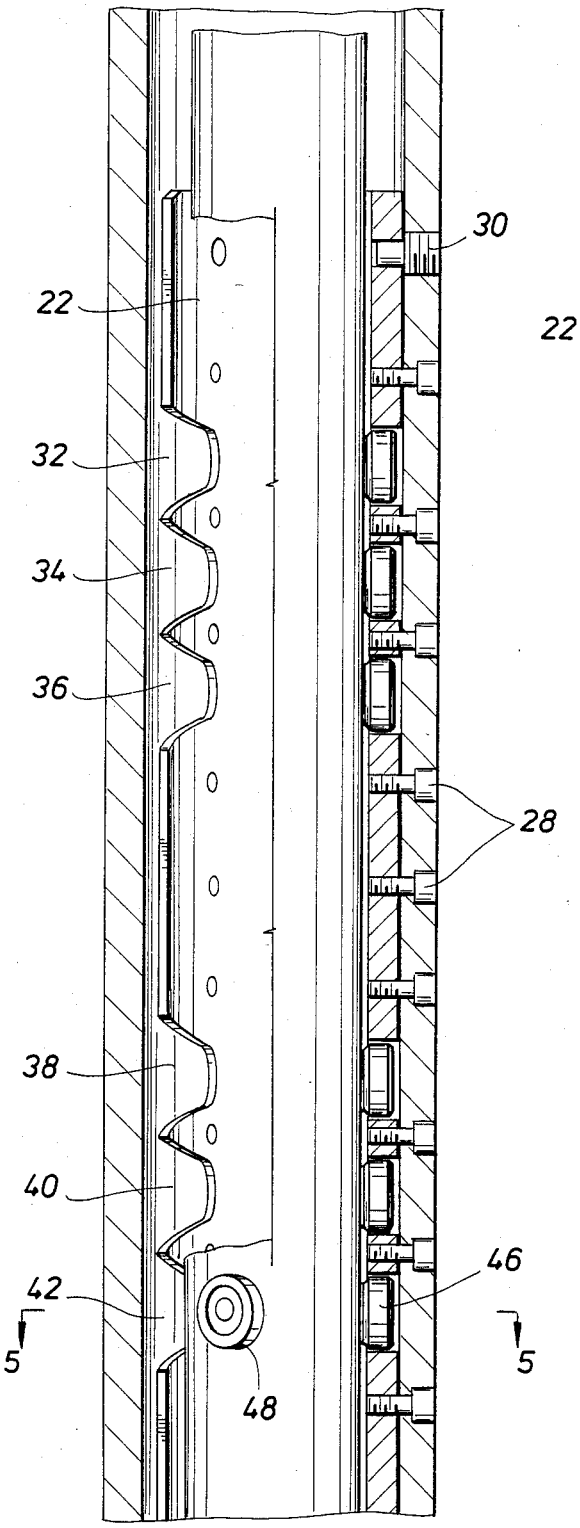
FIG. 5
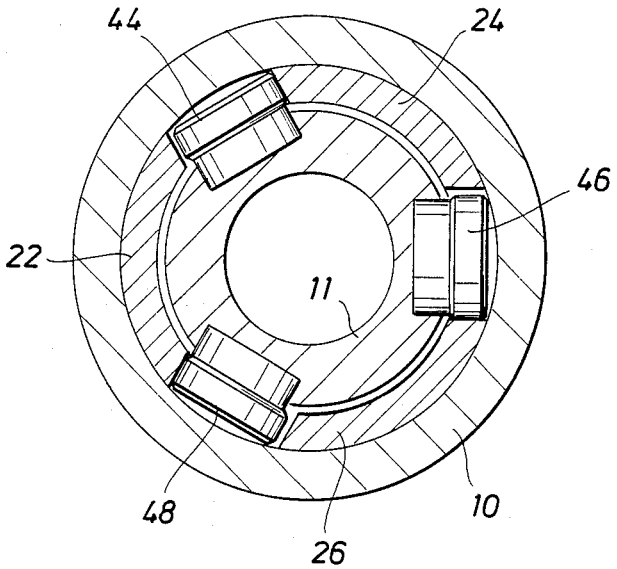
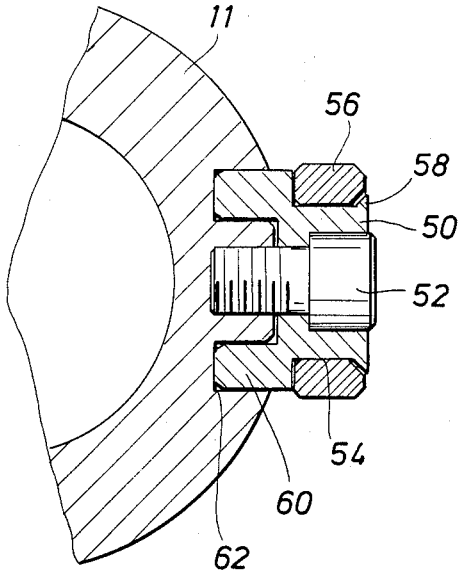
FIG. 6

MECHANICAL WELL JAR

This invention relates to well jars generally and in particular to mechanical jars that employ a spring operated mechanism in their operation.

Well jars are incorporated in the downhole assembly of a drill string. They are usually located just above the drill collars, since it is usually the drill collars that become stuck in the hole. If the jars are used in a fishing string, they are generally located just above the fishing tool. Their purpose is to strike a sharp blow on the stuck drill collars, fish or the like, tending to move it up or down and free it from whatever is holding it in the well bore, such as differential pressure, wall cake, and the like. The energy imparted to the fish by the jar is obtained from the drill pipe above it that acts as a long spring that is either compressed or stretched and then suddenly released to transmit the energy stored in the stretched or compressed drill pipe to the fish. These large amounts of energy, transmitted quickly to the fish in this matter, will tend to jar the fish free of whatever is holding it. "Fish" as used herein is meant to include not only the conventional fish, which is usually a portion of the drill string that has been left in the hole, but also stuck drill collars that are a part of the downhole drilling assembly.

The jars of this invention operate on the principle described in U.S. Pat. No. 3,208,541 and U.S. Pat. No. 3,233,690. Basically, the jars described in the patents and the jar of this invention include two telescoping members, an inner member and an outer member. In the jars described in the patents, the inner member was provided with a plurality of notches that had curved outwardly flaring sidewalls and a longitudinally extending groove. A plurality of rollers were mounted on the inside of the outer member for moving into and out of the notches and the groove. When the rollers were in the notches, the two telescoping members could not move longitudinally relative to each other. When the rollers were in the groove, the two members could move longitudinally relative to each other. Their movement longitudinally was limited by shoulders and it was through the shoulders that the energy stored in the drill pipe above during the operation of the jar was transmitted to the stuck fish.

In order to build up energy in the drill pipe, the rollers were held in the grooves by a spring. When the longitudinal force on the jars had a horizontal component due to the flared sidewalls of the notches that are large enough to rotate the two members relative to each other and force the rollers out of the groove, the jar would trip and the two members would move relative to each other with great velocity until they should meet. The impact of the engaging shoulders would produce a sharp blow on the fish. The amount of energy transmitted to the fish depended upon the spring force resisting the lateral movement of the rollers and the angle that the sides of the notches made with the horizontal, which determined the horizontal component produced by a given longitudinal force.

This arrangement has several drawbacks. With the rollers mounted on the inside of the outer member, it is practically impossible to check the condition of the rollers to determine, for example, if they were still rolling and whether or not they were cracked or even broken off. Usually the rollers were mounted on a shaft that extended into a hole in the side of the outer member. The shaft was welded to the outer member to hold the roller in position. The heat of the weld often caused the shaft to warp and cant the axis of rotation of the roller so that the roller did not rotate in a plane parallel to the vertical plane of the tool. This, in turn, would create undue stress concentrations on the roller and on the notch on the inner member resulting in galling of the metal surfaces and premature failure of the jars. In addition, as mentioned above, since the rollers were welded in place on the inside of the outer member, when one or more of the rollers were damaged beyond repair, the entire outer member would have to be replaced.

In view of the above problems with the prior art jars, it is an object of this invention to provide a mechanical jar of the type described above in which the rollers are mounted on the inner member and the notches are provided on the inner surface of the outer member and no welding is required to assemble the jar.

It is another object of this invention to provide such a mechanical jar where the rollers are mounted on the outside of the inner member where their condition can be easily checked and where the rollers are mounted in such a manner that any damaged rollers can be quickly replaced.

It is another object and advantage of this invention to provide a jar of the type described above in which the rollers are mounted on the outer surface of the inner member with the rollers supported by a shaft that transmits much of the bending moment imposed on the roller directly to the inner member thereby relieving the means holding the shaft in place on the inner member from much of this bending moment.

It is a further object, advantage, and feature of this invention to provide a jar of the type described above in which the U-shaped grooves are located in cam plates that are attached inside the outer member by threaded members that can be removed from the outside thereby allowing the cam plates to be removed, inspected, replaced or repaired easily and conveniently thereby greatly simplifying the maintenance required to keep the jars in good operating conditions.

These and other objects, advantages, and features of this invention will be apparent to those skilled in the art from a consideration of this specification, including the attached drawings and appended claims.

In the Drawings

FIG. 1 is a vertical, sectional view through the preferred embodiment of the well jar of this invention.

FIG. 2 is a sectional view taken along line 2—2 of FIG. 1.

FIG. 3 is a sectional view taken along line 3—3 of FIG. 1.

FIG. 4 is a vertical, sectional view on an enlarged scale of the portion of the jar in FIG. 1 where the cam plates and rollers are located.

FIG. 5 is a view taken along line 5—5 of FIG. 4.

FIG. 6 is a cross-sectional view through one of the roller assemblies attached to the inner member of the jar.

The jar includes outer member 10 and inner member 11 that are movable longitudinally relative to each other a limited distance. In FIG. 1, these tubular members are shown in one piece whereas they are actually made up of a number of tubular sections connected together by threads for ease of assembly and machining, and for ease of repair or replacement of worn or broken parts of the jar. Inner tubular member 11 is provided with appropriate threads (not shown) for connecting the inner member to the drill string extending between the jar and the surface. Outer member 10 has threads 12 on its lower end for connecting the outer tubular member to the fishing tool or the portion of the drill string extending below the jar. This is the usual arrangement. The roles of the two members could be reversed, if desired.

The distance the members can move longitudinally relative to each other is limited by annular shoulders on the members. When the jar is in use, the outer tubular member will be connected to the stuck pipe and therefore will not be doing any moving unless the jar can knock the fish loose from its stuck position in the well bore. Therefore, it is the inner member that moves relative to the outer member during a jarring operation. As the inner member moves downwardly, its travel is limited by the engagement of downwardly facing shoulder 14 on the inner member and upwardly facing shoulder 16 on the outer member. Upward movement is limited by downwardly facing shoulder 18 on the outer member and upwardly facing shoulder 20 on the inner member. In operation, as explained above, these shoulders come together with great force due to the energy stored in the drill pipe above the jar before the jar is tripped.

In this embodiment, the jar can jar up or it can jar down or both. Holding means are provided to hold the two members from relative movement while energy is being stored in the drill string. In the embodiment shown, the holding means includes three cam plates 22, 24, and 26 that are laterally spaced around the inner surface of the outer member. As shown in FIGS. 2 and 3, they are arcuate in cross-section to fit the curvature of the inner surface. The cam plates are held in position by a plurality of cap screws 28 that extend through openings provided in the wall of the outer member to engage tapped holes in the cam plates. To position the cam plates to receive the cap screws, locator pins 30, are positioned in openings in the sidewall of outer member 10 to engage a non-tapped locating hole at the upper end of each cam plate. These pins align the tapped holes in the plates with the openings in the sidewall of the outer member to insure that the cam plates are properly positioned relative to each other on the inside wall of the outer member. These locator pins are shown in FIG. 2.

Each cam plate has a plurality of U-shaped notches as best seen in FIG. 4 where the inner member is broken away to show cam plate 22 in elevation. In this embodiment, two longitudinally spaced sets of three notches each are used. The upper set is made up of notches 32, 34, and 36. The lower set is made up of notches 38, 40, and 42. The notches open outwardly in a lateral direction with diverging curved sidewalls.

A plurality of rollers are located on the outer surface of the inner member to engage the notches and hold the inner member from longitudinal movement relative to the outer member. When the rollers are out of engagement with the notches and positioned in the longitudinally extending spaces between the cam plates, as shown in FIG. 5, where rollers 44, 46, and 48 are positioned in between cam plates 22, 24, and 26, the inner member can move longitudinally relative to the outer member. The rollers are attached to the outer surface of inner member in equally spaced rolls in groups of three. They are spaced vertically as shown in FIG. 4 so each roller can engage one of the notches on the cam plates.

A typical roller assembly is shown in FIG. 6. It includes shaft 50 and cap screw 52 that attaches the roller assembly to inner member 11. Shaft 50 has cylindrical surface 54 upon which roller 56 is mounted for rotation relative to shaft 50. To assemble the roller on the shaft, cylindrical surface 54 extends outwardly to the end of the shaft. The roller is moved into position over the cylindri-cal surface and then the end of the shaft is upset to form retaining ring 58 to hold the roller on the shaft while allowing the roller to freely rotate relative to the shaft.

In order to relieve cap screw 52 of much of the stress imposed on shaft 50 by roller 56, the inner end of shaft 50 is cup-shaped to provide annular section 60 that extends into annular recess 62 in the sidewall of inner member 11. By designing annular section 60 of the shaft so that there is little clearance between the walls of the annular section and the walls of the recess, the reaction forces required to resist the load imposed on the shaft by the roller are transmitted directly to the inner member through annular section 60.

To hold the rollers in engagement with the notches, two torsion springs 64 and 66 are positioned at the lower end of the jar. The upper end of each spring is connected to the inner member through pins 68 and 70. These pins engage keyways 72 and 74 that extend along the outer surface of the inner member so that the spring can exert a torque on the inner member but still allow relative movement of the inner member relative to the springs. The lower end of each spring is connected to the outer member through pins 76 and 78.

Torque is imposed on the inner member by rotating the inner member relative to the outer member a desired distance and then inserting the pins. The torque constantly urges the inner member to rotate in a direction to move the rollers into the notches. The amount of torque imposed on the inner member determines at what upward or downward force the jar will trip. Also entering into the determination of when the jar will trip is the angle of the top and bottom sides of the notches. They do not have to be the same. The notches could be arranged to trip at a lesser force on a down jar then on an up jar, if desired.

As pointed out above, one of the advantages and features of this invention is that the inner member and the rollers can be quickly and easily removed from the outer member to allow inspection of the rollers for damage and wear. Any broken or worn rollers can be quickly and easily replaced. The cam plates can be quickly and easily removed for inspection and replacement simply by removing the locator pins and cap screws.

What is claimed is:

1. In a mechanical well jar having inner and outer tubular members movable longitudinally relative to each other a limited distance, means for connecting one of the members to a pipe string extending above the jar, means for connecting the other member to the pipe string below the jar, annular shoulders on the members that engage to limit the relative longitudinal movement of the members, the improvement comprising a plurality of laterally spaced, arcuate cam plates each attached to the inner surface of the outer member by threaded members that extend through the wall of the outer member and that can be removed from outside the outer member to allow the cam plates to be removed and repaired or replaced, each of said plates having a laterally extending U-shaped notch opening into the space between the plates and formed with curved outwardly flaring sidewalls, a plurality of roller assemblies each including a shaft threadedly attached to the outer surface of the inner member and a roller rotatable on the shaft to extend into the spaces between the cam plates for movement into the U-shaped notches to hold the members from longitudinal movement relative to each other, and resilient means urging the members to rotate in the direction to move the holding means into the notches and allow the holding means to move out of the notches when a longitudinal force is imposed on the jar sufficient for the flared sidewalls of the notches to provide a lateral component of force on the holding means that will overcome the force of the resilient means and move the holding means out of the notches allowing the tubular members to move longitudinally relative to each other and move the annular shoulders together sharply.

2. The jar of claim 1 in which the outer surface of the inner member has a plurality of annular recesses and the inner ends of the shafts of the roller assemblies are annular in cross-section and extend into the annular recesses when the roller assemblies are attached to the inner member to transmit to the inner member a portion of the bending force imposed on the roller assemblies when the roller assemblies are in engagement with the U-shaped notches.

* * * * *